US011793318B2

(12) United States Patent
Molinari

(10) Patent No.: US 11,793,318 B2
(45) Date of Patent: Oct. 24, 2023

(54) INDIVIDUALIZED BEDSHEET SYSTEM

(71) Applicant: Kathleen Molinari, Elk River, MN (US)

(72) Inventor: Kathleen Molinari, Elk River, MN (US)

( * ) Notice: Subject to any disclaimer, the term of this patent is extended or adjusted under 35 U.S.C. 154(b) by 130 days.

(21) Appl. No.: 17/348,054

(22) Filed: Jun. 15, 2021

(65) Prior Publication Data

US 2021/0393044 A1 Dec. 23, 2021

Related U.S. Application Data

(60) Provisional application No. 63/053,452, filed on Jul. 17, 2020, provisional application No. 63/041,327, filed on Jun. 19, 2020.

(51) Int. Cl.
*A47C 21/02* (2006.01)
*A47C 31/00* (2006.01)

(52) U.S. Cl.
CPC ..... *A47C 21/022* (2013.01); *A47C 31/003* (2013.01)

(58) Field of Classification Search
CPC ..... A47C 21/022; A47C 31/003; A47G 9/02; A47G 9/0238
See application file for complete search history.

(56) References Cited

U.S. PATENT DOCUMENTS

| | | | | |
|---|---|---|---|---|
| 2,497,186 | A * | 2/1950 | Pedersen | A47C 21/022 5/494 |
| 5,287,573 | A | 2/1994 | Ritacco | |
| 5,572,754 | A * | 11/1996 | Lazar | A47C 21/022 5/500 |
| 6,108,836 | A * | 8/2000 | Keene, III | A47G 9/02 5/482 |
| 6,539,565 | B1 | 4/2003 | Trimble | |
| 6,907,628 | B2 | 6/2005 | El Guermaai | |
| 7,100,223 | B1 | 9/2006 | Anthony | |
| 7,124,455 | B2 | 10/2006 | Demarco et al. | |
| 7,200,883 | B2 | 4/2007 | Haggerty | |
| 8,032,959 | B2 | 10/2011 | Rowson et al. | |
| 8,122,541 | B1 | 2/2012 | Georgatos | |
| 10,022,000 | B2 | 7/2018 | Walvius et al. | |
| 10,143,312 | B2 | 12/2018 | Brosnan et al. | |
| 10,368,654 | B2 | 8/2019 | Sopher | |
| 2003/0177579 | A1* | 9/2003 | Diak/Ghanem | A47G 9/02 5/484 |
| 2005/0132498 | A1 | 6/2005 | Vrionis | |

(Continued)

FOREIGN PATENT DOCUMENTS

| | | | |
|---|---|---|---|
| CN | 109288337 | A | 2/2019 |
| DE | 102006056075 | A1 | 7/2008 |

*Primary Examiner* — Robert Sandy
*Assistant Examiner* — Louis A Mercado
(74) *Attorney, Agent, or Firm* — Merchant & Gould P.C.

(57) ABSTRACT

The disclosed bedsheet system includes a middle portion, a foot connector, and a head connector that allows for quick removal and/or addition of sheets. The middle portion has a length and a width defining a plane, the length has a first end and a second end. The foot connector is attached to the first end of the middle portion and has at least one sheet connector mechanism. The head connector is attached to the second end of the middle portion and has at least one sheet connector mechanism. The foot connector and the head connector extend generally perpendicular from the plane of the middle portion.

19 Claims, 9 Drawing Sheets

(56) References Cited

U.S. PATENT DOCUMENTS

| | | | | |
|---|---|---|---|---|
| 2005/0217030 | A1* | 10/2005 | Seigler | A47C 27/003 5/738 |
| 2007/0061967 | A1 | 3/2007 | Fox | |
| 2007/0157383 | A1 | 7/2007 | Burns | |
| 2010/0017962 | A1 | 1/2010 | Bevan | |
| 2010/0313356 | A1 | 12/2010 | Morter | |
| 2013/0014326 | A1 | 1/2013 | Kane et al. | |
| 2014/0026321 | A1* | 1/2014 | Lyons | A47G 9/023 5/502 |
| 2015/0196146 | A1* | 7/2015 | Liddick | A47G 9/02 5/486 |
| 2016/0242559 | A1* | 8/2016 | Hui | A47G 9/0246 |
| 2018/0344552 | A1* | 12/2018 | Kamara | A61G 7/05715 |
| 2019/0099018 | A1* | 4/2019 | Holt | A47G 9/0238 |
| 2020/0260886 | A1* | 8/2020 | Chen | A47C 21/022 |

* cited by examiner

INDIVIDUALIZED BEDSHEET SYSTEM

CROSS-REFERENCE TO RELATED APPLICATIONS

This application claims priority to U.S. Provisional Application Ser. No. 63/053,452, filed on Jul. 17, 2020, and U.S. Provisional Application Ser. No. 63/041,327, filed on Jun. 19, 2020, the entire disclosures of which are hereby expressly incorporated herein by reference.

TECHNICAL FIELD

This disclosure relates to a system of providing an individualized bedsheet system.

BACKGROUND

People who share a bed often require different sheets or blankets to be comfortable. One person may only want a sheet, while the other person may want a blanket. If one person is not comfortable while sleeping, it can lead to a lack of sleep, or poor sleep quality.

Previous solutions provide a single system that provides split covers, but are not useable with existing sheets and/or do not allow a user to layer sheets and blankets as desired.

In other situations, it is desirable to be able to change the sheets and/or blankets on a bed without changing all the sheets on the bed. Further, it is desirable to be able to change sheets/blankets on a bed very quickly.

SUMMARY

In general terms, this disclosure is directed towards a bedsheet system that is useful for a bed that is shared by two people. In another embodiment, the bedsheet system is useful for layering bottom sheets on a mattress for quick changing.

The bedsheet system allows for one person to use different bottom sheets, top sheets, blankets, or combinations thereof, than the other person in the same bed, all the while the bottom sheet, top sheet, and/or blanket are connected to at least the head or foot of the bed.

In a first aspect, a bedsheet system comprises a middle portion, a foot connector, and a head connector. The middle portion has a length and a width defining a plane, the length has a first end and a second end. The foot connector is attached to the first end of the middle portion and has at least one sheet connector mechanism. The head connector is attached to the second end of the middle portion and has at least one sheet connector mechanism. The foot connector and the head connector extend generally perpendicular from the plane of the middle portion.

In a second aspect, a bedsheet system comprises a middle portion, a foot connector, and a head connector. The middle portion has a length and a width defining a plane. The length has a first end and a second end. The foot connector is attached to the first end of the middle portion and has at least one sheet connector mechanism. The head connector is attached to the second end of the middle portion and has at least one sheet connector mechanism. The foot connector and the head connector extend generally perpendicular from the plane of the middle portion. The sheet connector mechanism comprises a first and second wing capable of connecting to a standard issue sheet.

In a third aspect, a bedsheet system comprises a middle portion, a foot connector, a head connector, and at least one sheet. The middle portion has a length and a width defining a plane. The length has a first end and a second end. The foot connector is attached to the first end of the middle portion and has at least one sheet connector mechanism. The head connector is attached to the second end of the middle portion and has at least one sheet connector mechanism. The foot connector and the head connector extend generally perpendicular from the plane of the middle portion. The at least one sheet comprises a complementary sheet connector mechanism and is capable of removably connecting to the sheet connector mechanism.

Corresponding reference characters indicate corresponding parts throughout the several views. The exemplifications set out herein illustrate an embodiment of the invention, and such exemplifications are not to be construed as limiting the scope of the invention in any manner.

BRIEF DESCRIPTION OF THE DRAWINGS

The present disclosure will be described hereafter with reference to the attached drawings which are given as non-limiting examples only, in which.

DETAILED DESCRIPTION

Figure 1:
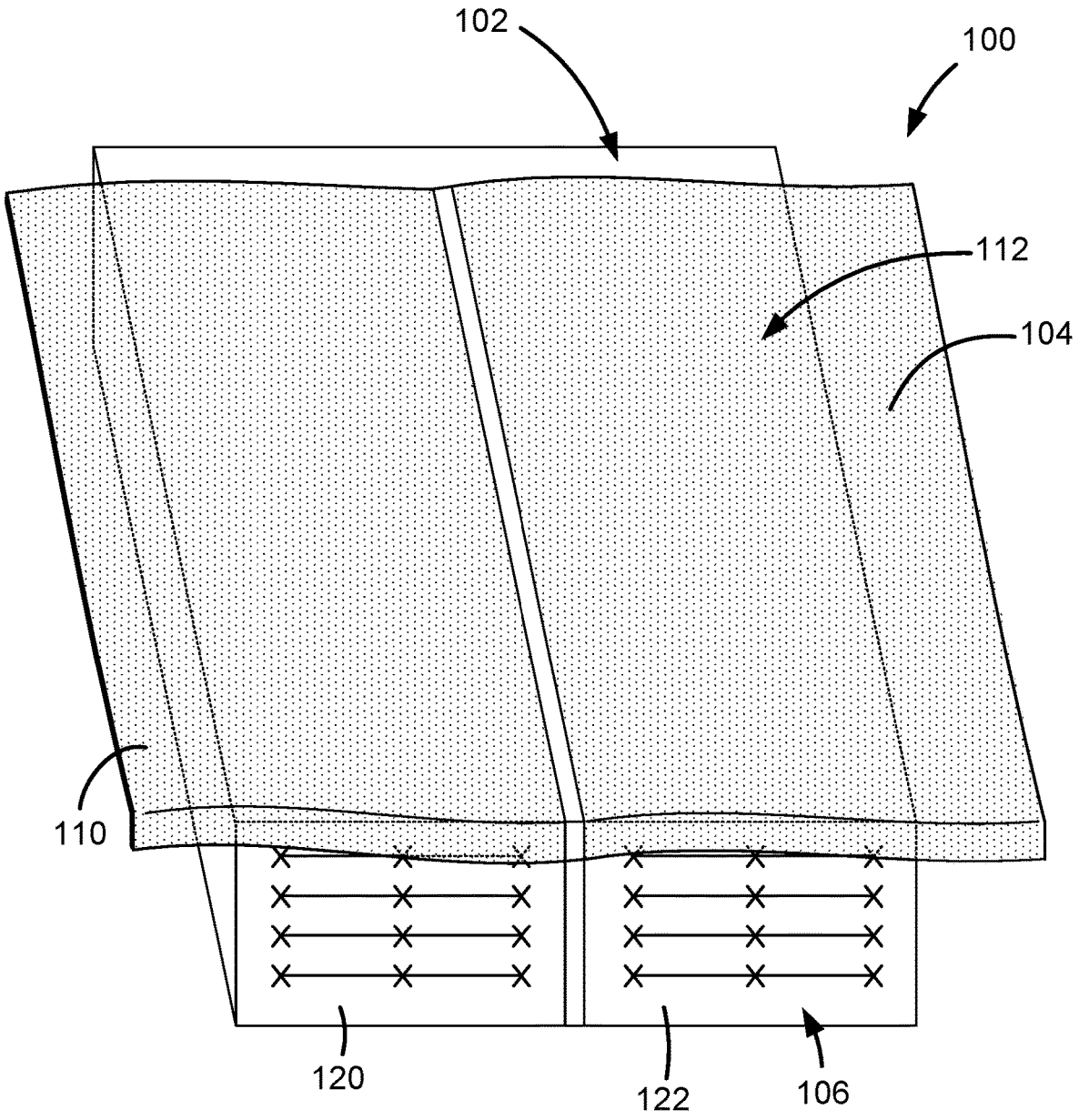
FIG. 1 illustrates an example embodiment of the connector system.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

This disclosure relates generally to a bedsheet system that allows for the quick removal and/or addition of sheets or blankets and/or the ability to have different sheets or blankets on the left or right side of a bed. Still further, differing number of sheets and/or blankets can be on the left or right side of the bed, depending on the needs of the individual.

In a first embodiment, the bedsheet system described herein is useful for a double, queen, or king size bed that is shared by two people. The bedsheet system allows for one person to use different bottom sheets, top sheets, blankets, or combinations thereof, than another person in the same bed, all the while the bottom sheet, top sheet, and/or blanket are connected to at least the head and/or foot of the bed.

In another embodiment, the bedsheet system described herein is useful for layering bottom sheets on a mattress. This may be useful for a baby or toddler, wherein it is beneficial to have layered sheets for easy removal if one sheet gets soiled. For example, if a child wets the bed in the middle of the night, the wet sheets may be easily removed from the bedsheet system described herein, without having to entirely remake the bed.

In yet another embodiment, the bedsheet system described herein includes the ability to layer bottom sheets and a combination of sheets and/or blankets on the top.

FIG. 1 illustrates an example embodiment of the connector system 100. The connector system 100 includes a head connector 102, a middle portion 104, and a foot connector 106. One end of the head connector 102 is attached to a first end of the middle portion 104, and one end of the foot connector 106 is attached to a second end of the middle portion 104. The connector system 100 forms a "U-shape" and is configured to have the middle portion 104 fit below a standard mattress.

The connector system 100 as shown also includes a first sheet 110 attached to a first side 120 of the foot connector 106, and a second sheet 112 attached to a second side 122 of the foot connector 106. The first sheet 110 may be different material than the second sheet 112, for example, the first sheet 110 may be a sheet, while the second sheet 112 may be a blanket.

The first sheet 110 and the second sheet 112 are not connected. While sheets are described herein, any type of covering may be utilized. For example, a first sheet 110 or a second sheet 112 may be a sheet, a light blanket, a heavy blanket, a comforter, or something similar. This allows a single mattress to have different sheets on each side of the bed, or a different number of sheets on each side of the bed. As described in more detail below, the first sheet 110 or second sheet 112 may be a specialized sheet, or may be a standard issue sheet used with an adapter.

Figure 2:
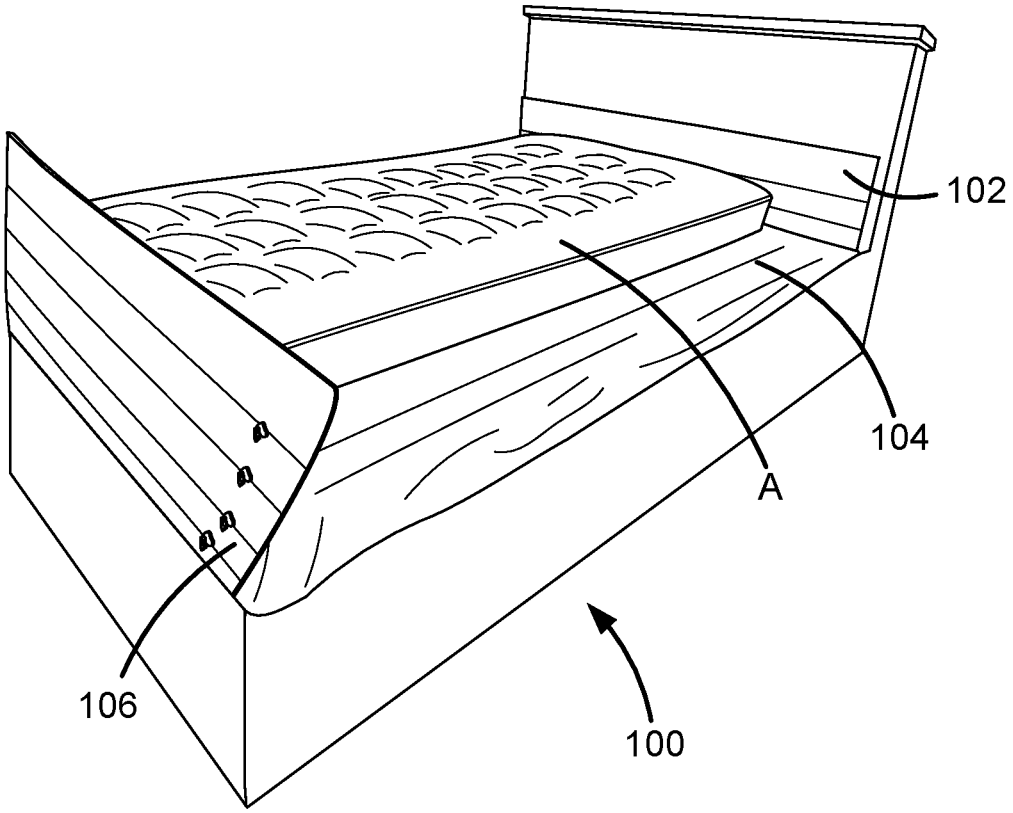
FIG. 2 illustrates an example embodiment of the connector system.

FIG. 2 illustrates an example embodiment of the connector system 100, wherein the middle portion 104 resides below a mattress A. The head connector 102 is located at a head of the bed, and the foot connector 106 is located at a foot of the bed.

The head connector 102 and the foot connector 106 extend generally upright from the middle portion 104. As shown, the head connector 102 and the foot connector 106 extend generally perpendicular from the plane of the middle portion 104. This allows the head connector 102 and the foot connector 106 to extend around the shape of a standard mattress.

Figure 3:
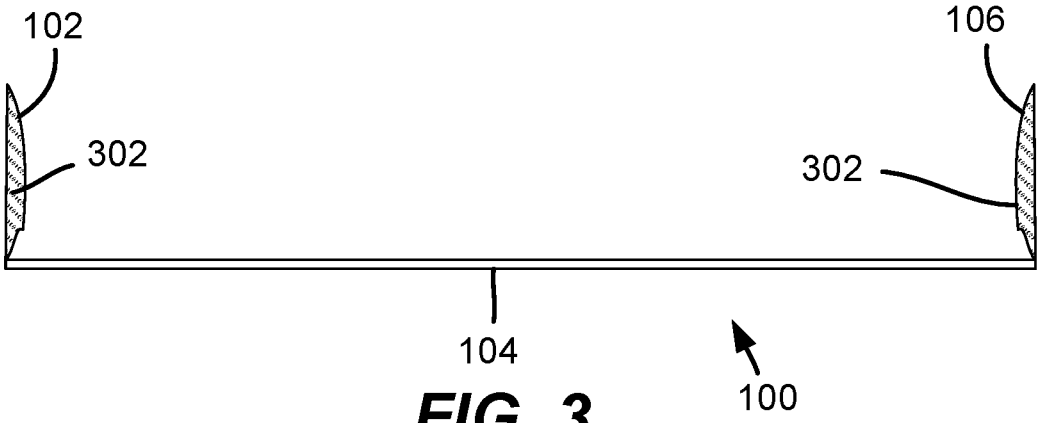
FIG. 3 illustrates a cross-sectional side view of the connector system.

FIG. 3 illustrates a cross-sectional side view of the connector system 100. The middle portion 104 is located between a head connector 102 and a foot connector 106. The middle portion 104 may be made from a variety of materials, such as fabric; however, other materials are possible. The head connector 102 and the foot connector 106 may also be made from a variety of materials, such as fabric. In a further embodiment, the head connector 102 and/or the foot connector 106 may be made from a stiff material, such as a plastic. In still further embodiments, the head connector 102 and/or the foot connector 106 include a pocket opening 302, wherein the head connector 102 and/or the foot connector 106 are made from a fabric material and include a stiff material located within the pocket opening 302.

Figure 4A:
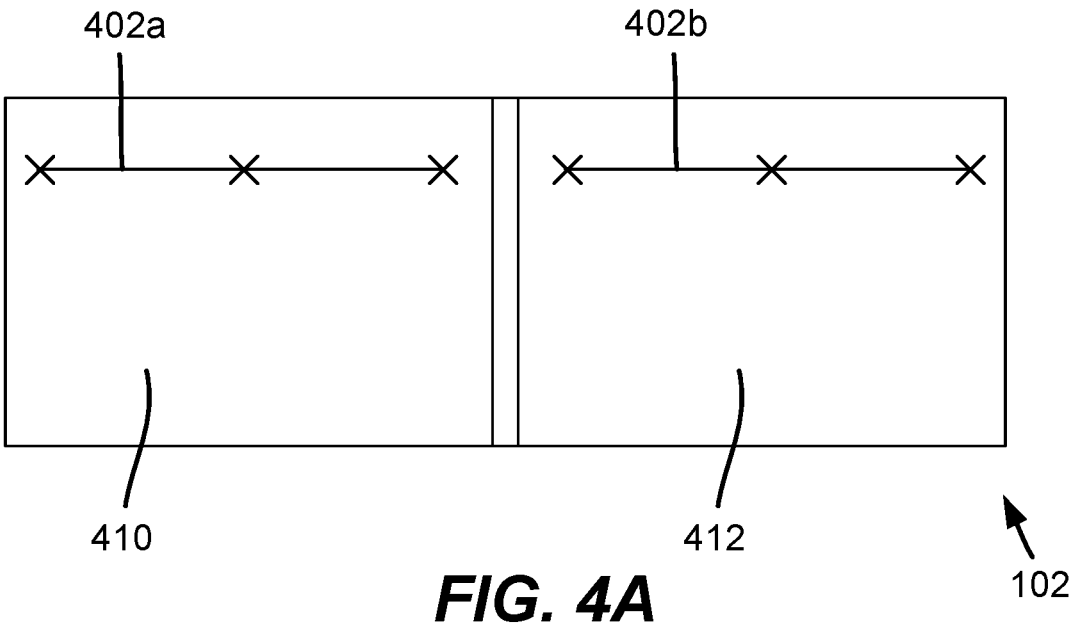
FIG. 4A illustrates a perspective view of the head connector.

FIG. 4A illustrates a perspective view of the head connector 102. The head connector 102 includes a connector mechanism 402*a* on a first side 410, and a connector mechanism 402*b* on a second side 412. The connector mechanism 402*a*, and the connector mechanism 402*b* are separated from one another. The connector mechanisms 402*a*, 402*b* are capable of connecting to different sheets. For example, the connector mechanism 402*a* of the head connector 102 is useful for connecting a bottom sheet, wherein the bottom sheet is also connected to a connector mechanism 402*a* of the foot connector 106.

Although only a single row of connector mechanisms 402 are shown on the head connector 102, in alternative embodiments, more than one row of connector mechanisms 402 may be located on the head connector 102, such as described below with regard to the foot connector 106. Such an embodiment may be useful for a crib mattress. For example, multiple bottom sheets may be capable of being connected to the head connector 102 and the foot connector 106. This allows for quick changing of the bottom sheet in a crib. This is advantageous for use with a baby or toddler where being able to change the sheets quickly in the event of an accident, such as wetting the bed or spit up, is desirable.

The connector system 100 may be sized for different mattresses. For example, a toddler or twin mattress may only have a single column of connector mechanisms 402. A single column of connector mechanisms 402 is useful for a mattress for a single individual. A full, queen, king, or California king sized mattress may have the two columns of connector mechanisms 402. Two columns of connector mechanisms 402 are useful for a mattress for two individuals.

In a first embodiment, the connector mechanism 402 attaches directly to a sheet. In an alternative embodiment, and as described below, the connector mechanism 402 may be attached to an adapter, which is then attached to a standard issue sheet. The connector mechanism 402 may comprise a first portion of a zipper, which is capable of connecting to a sheet comprising the other portion of the zipper. The connector mechanism 402 may alternatively comprise other types of connectors, such as a hook and loop connector, magnets, or other similar mechanisms.

Figure 4B:
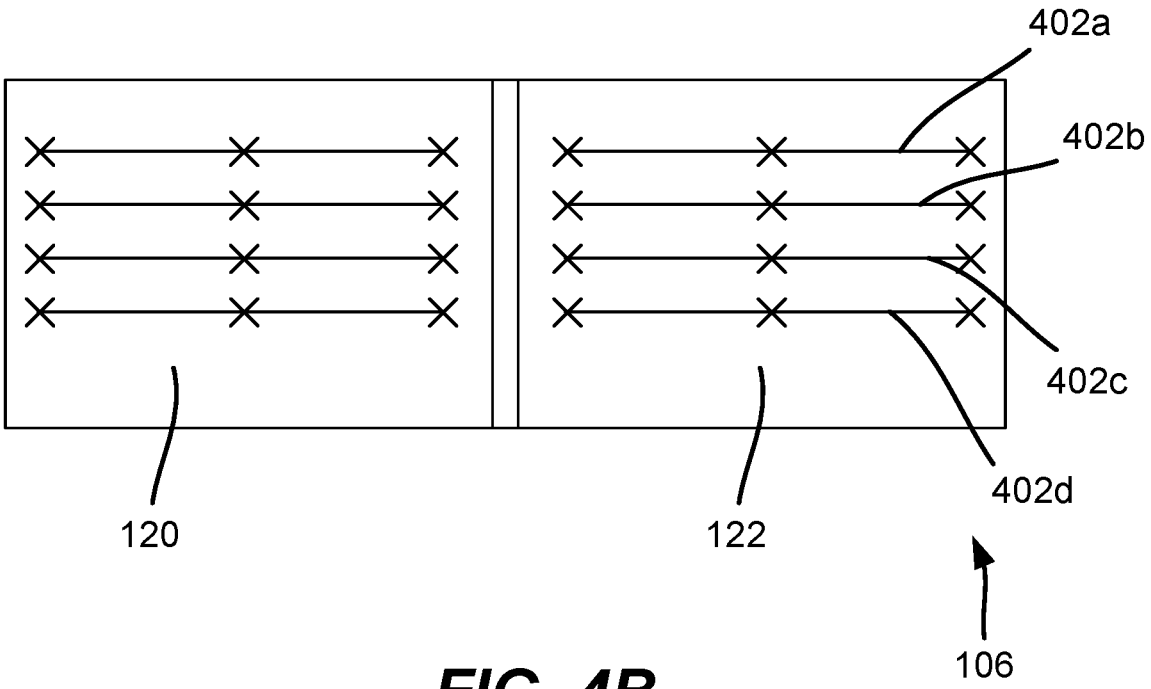
FIG. 4B illustrates a perspective view of the foot connector.

FIG. 4B illustrates a perspective view of the foot connector 106. The foot connector 106 includes a plurality of connector mechanisms 402. For example, as shown, four rows of connector mechanisms 402*a*, 402*b*, 402*c*, 402*d*, are shown. In an embodiment, the first side 120 and the second side 122 have the same number of rows of connector mechanisms 402; however, the first side 120 and the second side 122 may have a different number of rows of connector mechanisms 402. The connector mechanisms 402 located on the first side 120, and the connector mechanisms 402 located on the second side 122 are separated from one another. The connector mechanism 402 is capable of connecting to a sheet. For example, the connector mechanism 402*a* of the foot connector 106 is useful for connecting a bottom sheet, wherein the bottom sheet is also connected to the head connector 102.

The rows of connector mechanisms 402 allow for a plurality of different sheets to be connected to the foot connector 106. For example, a bottom sheet may be connected to the connector mechanism 402*a*, a top sheet may be connected to the connector mechanism 402*b*, a first blanket may be connected to the connector mechanism 402*c*, and a comforter may be connected to the connector mechanism 402*d*.

In a first embodiment, the connector mechanism 402 attaches directly to a sheet. In an alternative embodiment, and as described below, the connector mechanism 402 may be attached to an adapter, which is then attached to a standard issue sheet. The connector mechanism 402 may comprise a first portion of a zipper, which is capable of connecting to a sheet comprising the other portion of the zipper. The connector mechanism 402 may alternatively comprise other types of connectors, such as a hook and loop connector, magnets, or other similar mechanisms.

Figure 5A:
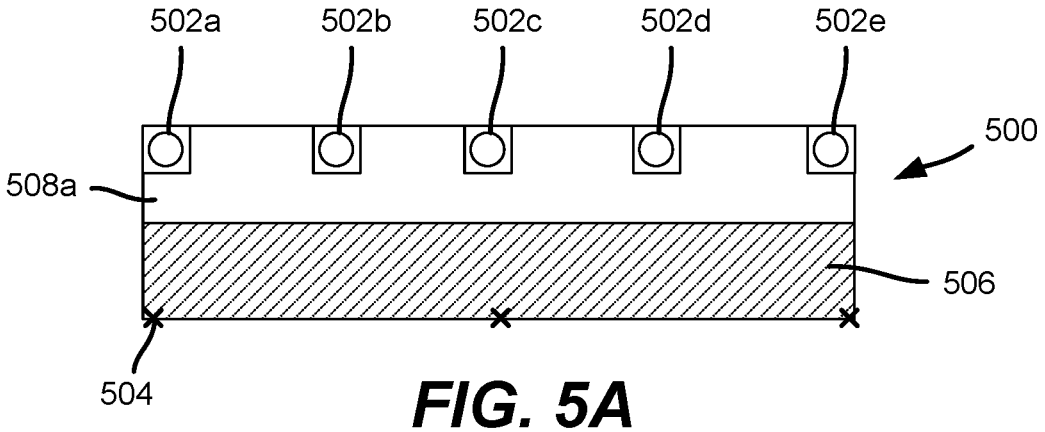
FIG. 5A illustrates an example embodiment of an adapter.

FIG. 5A illustrates an example embodiment of an adapter 500. The adapter 500 is useful for connecting a standard issue sheet to the connector system 100. The adapter 500 includes an adapter base portion 506, a first adapter wing 508*a*, and a second adapter wing (not shown).

The adapter base portion 506 includes a connecting mechanism 504, which connects to the connector mechanism 402 of either the head connector 102 or the foot connector 106. The connecting mechanism 504 may comprise a first portion of a zipper, which is capable of connecting to the other portion of the zipper of the connector mechanism 402. The connecting mechanism 504 may alternatively comprise other types of connectors, such as a hook and loop connector, magnets, or other similar mechanisms.

Each of the adapter wings 508*a*, 508*b* comprise a plurality of attachment mechanisms 502. As shown, five attachment mechanisms 502*a*, 502*b*, 502*c*, 502*d*, 502*e* are located on the adapter wing 508. The attachment mechanisms 502 comprise a magnet that is capable of holding a standard issue sheet between the first adapter wing 508*a* and the second adapter wing 508*b*.

Figure 5B:
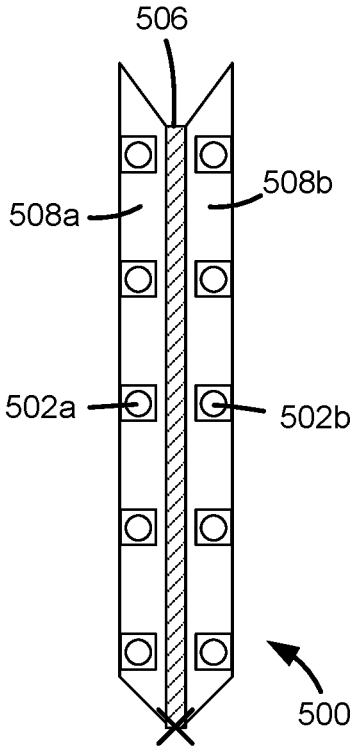
FIG. 5B illustrates an alternative view of an example embodiment of the adapter.

FIG. 5B illustrates an example embodiment of the adapter 500 with the first adapter wing 508*a* separated from the second adapter wing 508*b*. As shown, the first adapter wing 508*a* is connected to the second adapter wing 508*b* at the adapter base portion 506. The plurality of attachment mechanisms 502*a*, 502*b* are located along an edge of the adapter wings 508*a*, 508*b* opposite the adapter base portion 506. One portion of the attachment mechanism 502*a* is located along the adapter wing 508*a* at a location that aligns with the opposing portion of the attachment mechanism 502*b* of the adapter wing 508*b*. The attachment mechanisms 502 are equidistantly spaced along the edge of the adapter wings 508.

Figure 5C:
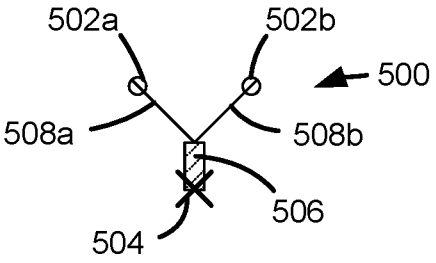
FIG. 5C illustrates a cross-sectional view of the adapter.

FIG. 5C illustrates a cross-sectional view of the adapter 500. As shown, the first adapter wing 508*a* is separable from the second adapter wing 508*b*, but are connected to the adapter base portion 506. A sheet is capable of being placed between the first adapter wing 508*a* and the second adapter wing 508*b*, and using the attachment mechanism 502, is held securely in place.

In an alternative embodiment, the adapter 500 may be fixedly connected to the head connector 102 and/or the foot connector 106. Still further, the head connector 102 and/or the foot connector 106 may include the first adapter wing 508*a* and the second adapter wing 508*b* to directly connect to a standard issue sheet without the need for an additional adapter piece.

Figure 6:
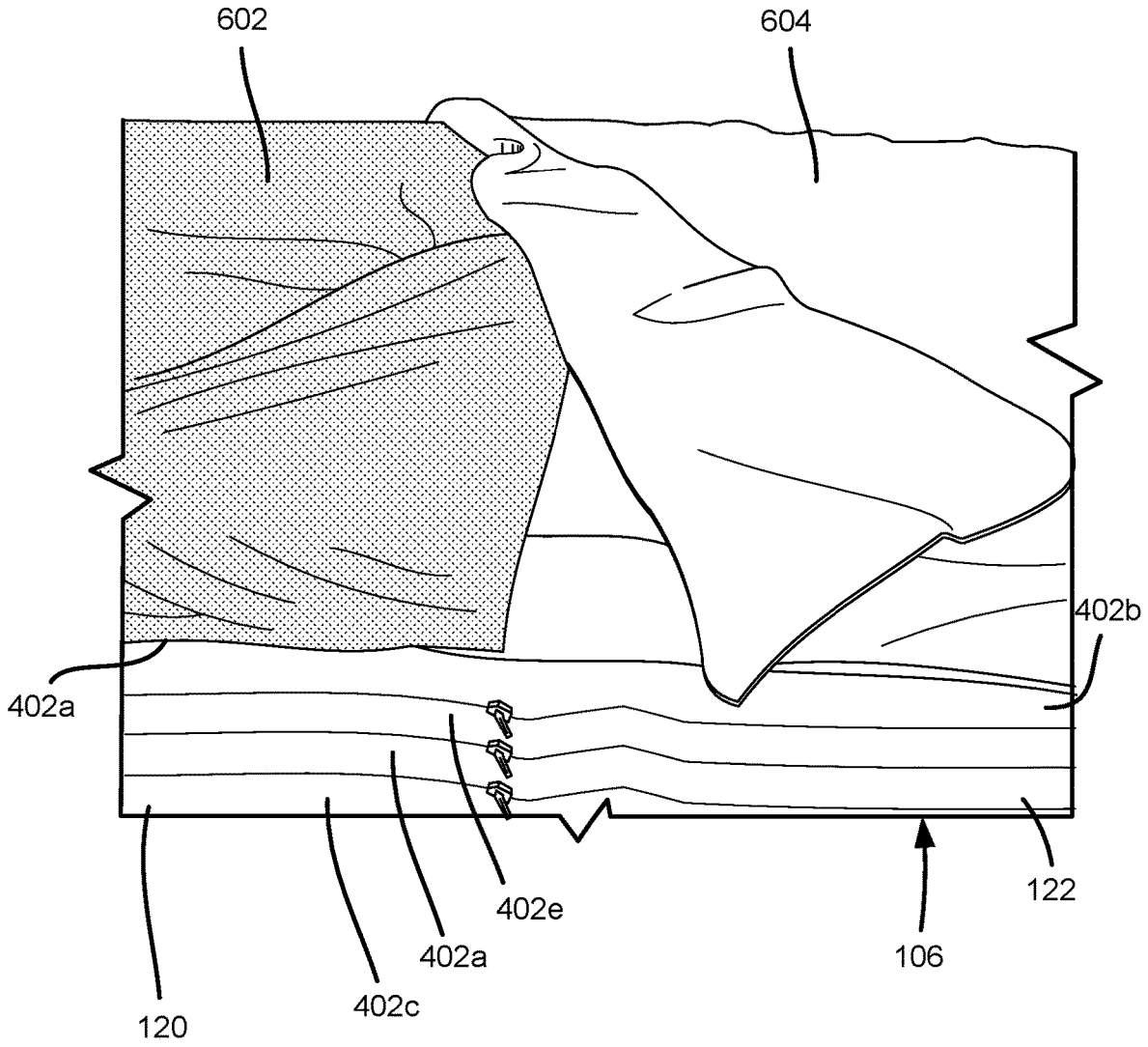
FIG. 6 illustrates an example embodiment of the foot connector connected to a first sheet.

FIG. 6 illustrates an example embodiment of the foot connector 106 comprising a first sheet 602 attached to a connector mechanism 402*a* on the first side 120, and a second sheet 604 attached to a connector mechanism 402*b* on the second side 122. As shown, the first sheet 602 is different than the second sheet 604. Unused connector mechanisms 402*c*, 402*d*, and 402*e*, are also shown.

Figure 7:
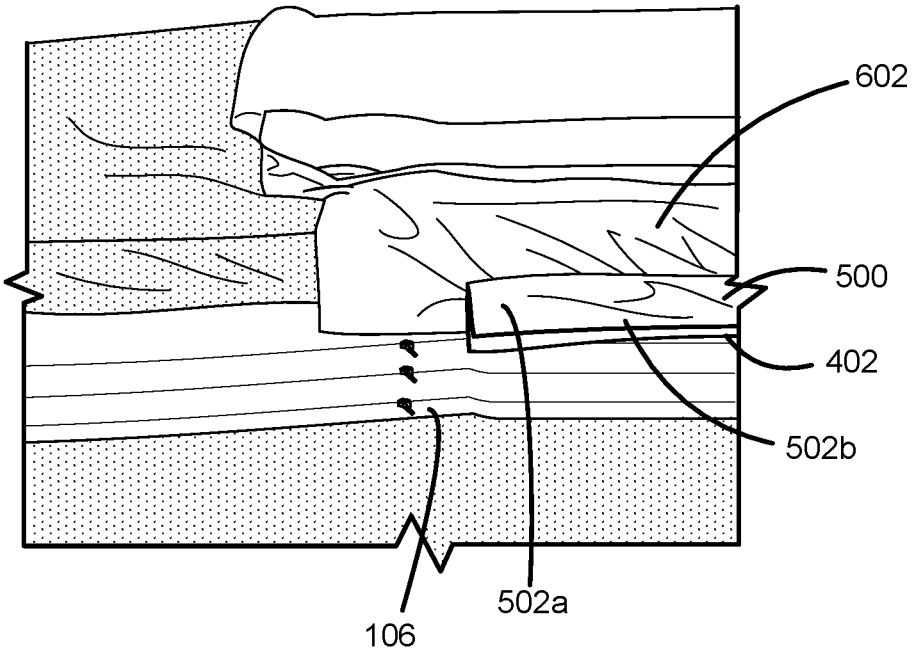
FIG. 7 illustrates an example embodiment of the foot connector connected to an adapter.

FIG. 7 illustrates an example embodiment of the foot connector 106 connected to an adapter 500 which is connected to the first sheet 602. The adapter 500 is connected to the first sheet 602 via a plurality of attachment mechanisms 502*a*, 502*b* on a first end, and is connected to the foot connector 106 via the connector mechanism 402 on a second end.

Figure 8A:
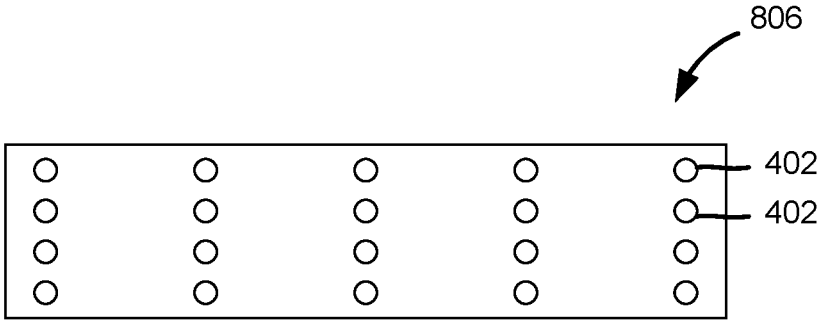
FIG. 8A illustrates an alternative embodiment of a connector.

FIG. 8A illustrates an alternative embodiment of a connector 806 (useful at either the foot or head of a mattress) having a plurality of connector mechanisms 402. In the embodiment shown, the connector mechanisms 402 are magnets. In other embodiments, other types of connector mechanisms 402 may be used.

Figure 8B:
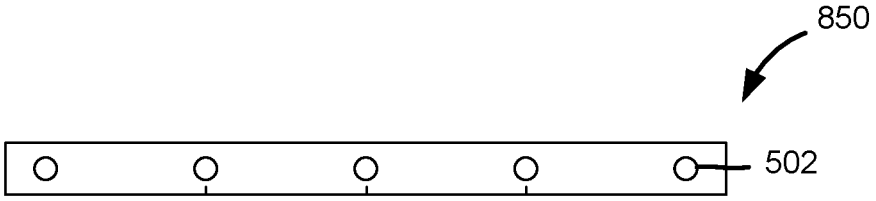
FIG. 8B illustrates an alternative embodiment of an adapter.

FIG. 8B illustrates an alternative embodiment of an adapter 850 having a plurality of attachment mechanisms 502. In the embodiment shown, the attachment mechanisms 502 are magnets. In other embodiments, other types of attachment mechanisms 502 may be used. The example adapter 850 is configured to be placed within an enlarged pocket hem of a sheet.

Figure 9:
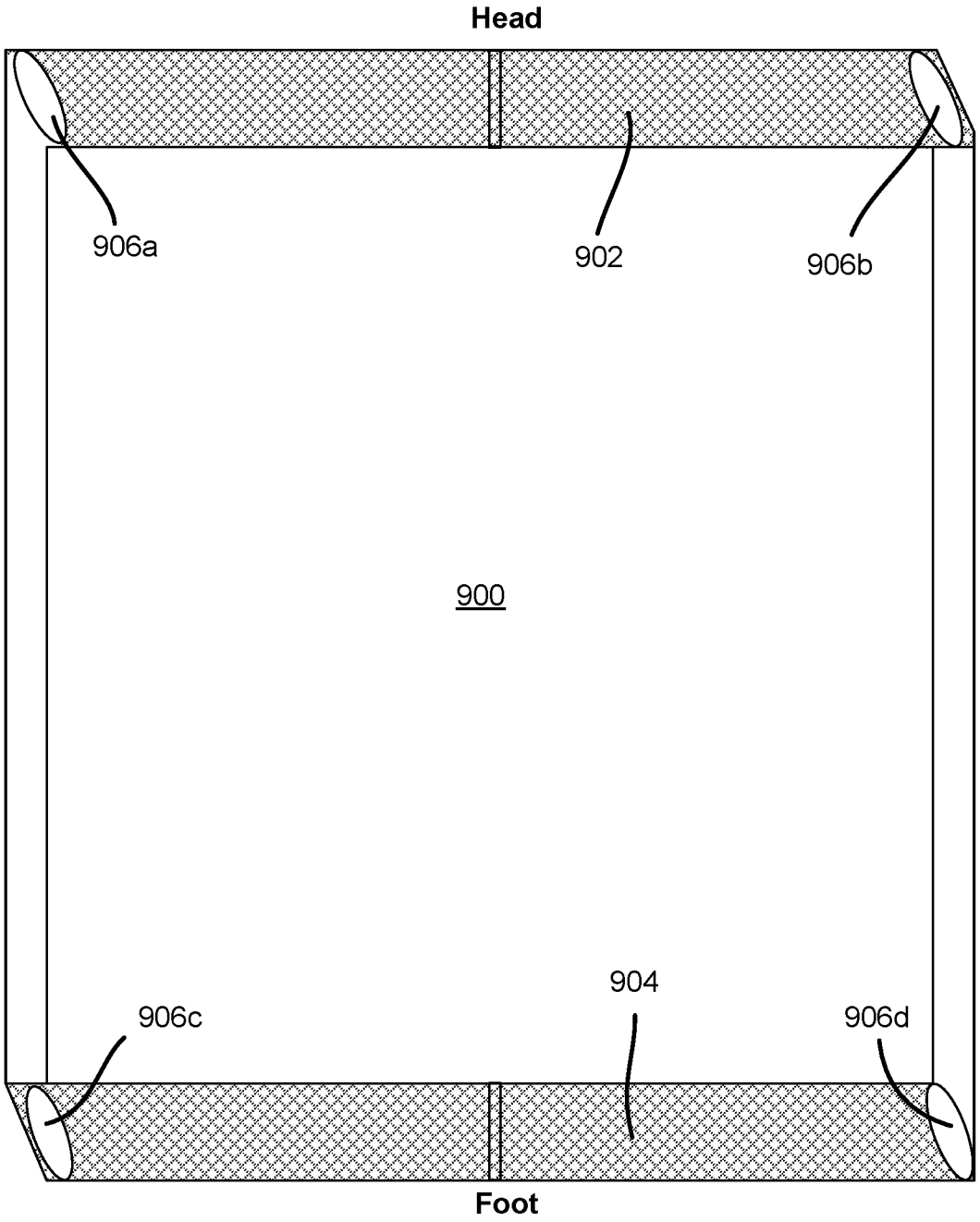
FIG. 9 illustrates an example mattress having two pockets.

FIG. 9 illustrates an example mattress 900 having a pocket 902 at the head of the mattress 900 and a pocket 904 at the foot of the mattress 900. The pockets 902, 904 may be made from a fabric material, such as a thin gauze material.

The pockets 902, 904 may be accessible by an opening 906*a*, 906*b*, 906*c*, 906*d* located at each of the four corners of the mattress 900.

The connector 806 may be inserted through one of the openings 906 into one of the pockets 902, 904 of the mattress 900. A sheet may be connected via the adapter 850 to the connector 806. As described, the adapter 850 is placed within a hem of a sheet, and the attachment mechanisms 502 connect with the connector mechanisms 402 of the connector 806.

Figure 10:
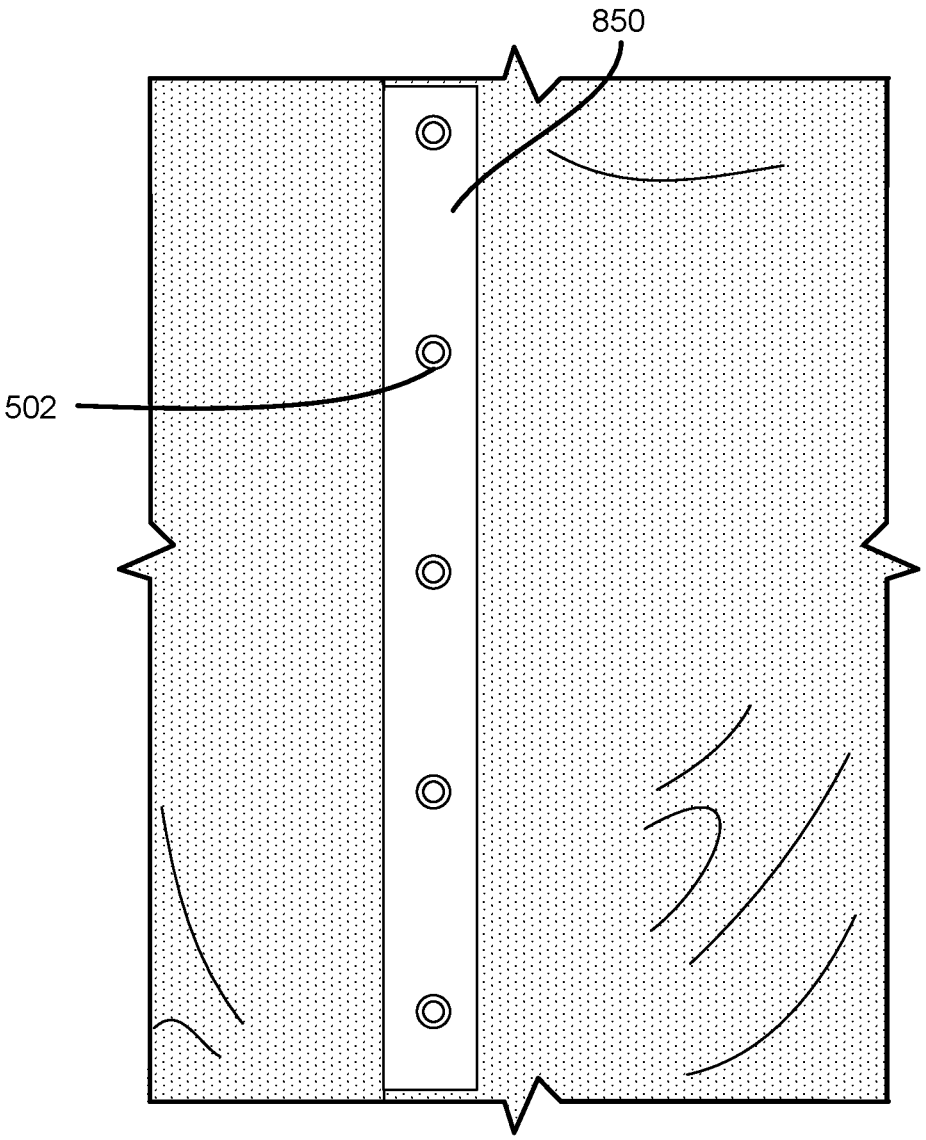
FIG. 10 illustrates an example embodiment of the adapter of FIG. 8A.

FIG. 10 illustrates an example embodiment of an adapter 850. The adapter 850 includes at least a row of a plurality of attachment mechanisms 502. The adapter 850 may be made from a variety of materials, both flexible and stiff. In an embodiment, the adapter 850 is made from a fabric material. In another embodiment, the adapter 850 is made from a stiff material, such as plastic or cardboard.

The attachment mechanisms 502 are configured to engage with the connector mechanisms 402.

Figure 11:
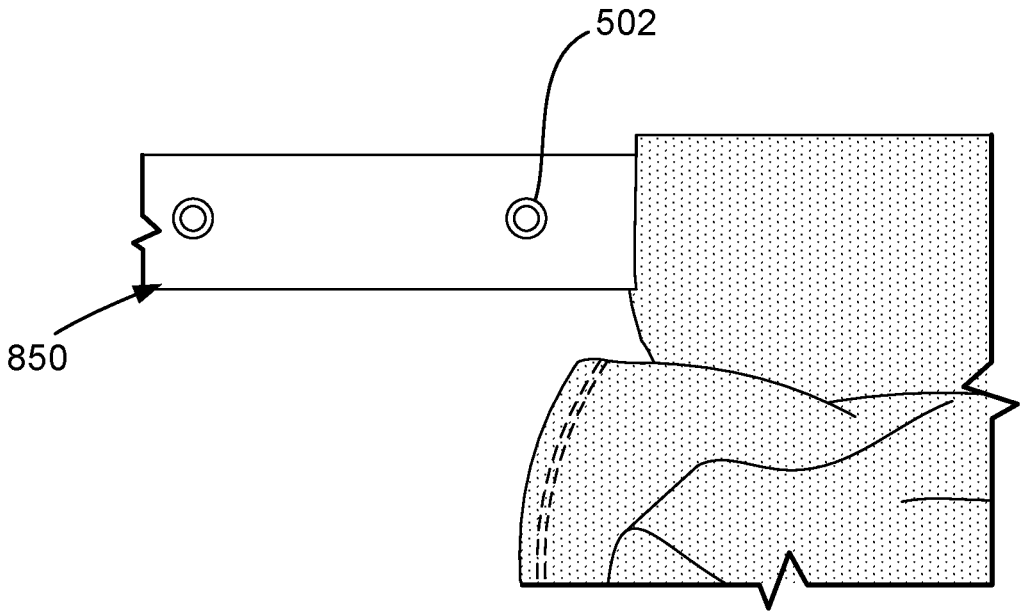
FIG. 11 illustrates an example embodiment of an adapter placed within a hem of a sheet.

FIG. 11 illustrates an example embodiment of an adapter 850 placed within a hem of a sheet. The same adaptor 850 may be placed in the pocket 902 and the pocket 904. In an alternative embodiment, different adaptors 850 having a different number of attachment mechanisms 502 may be placed in the pocket 902 and the pocket 904. In such an embodiment, the adaptor 850 is placed at the head of a mattress and the connector 806 is placed at the foot of the mattress.

Figure 12:
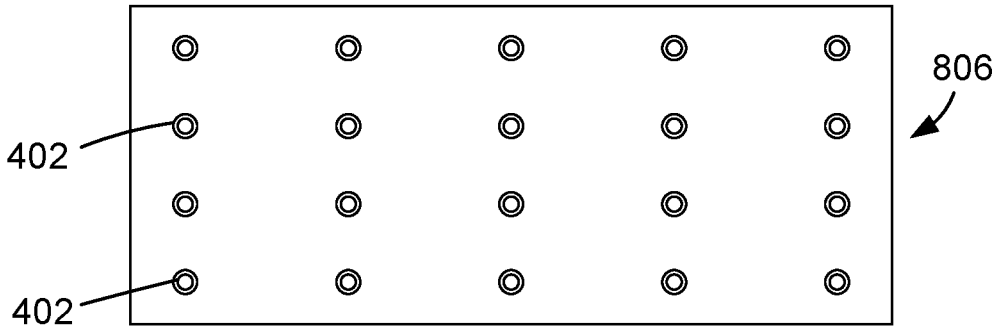
FIG. 12 illustrates an example embodiment of the connector of FIG. 8B.

FIG. 12 illustrates an example embodiment of a connector 806. The connector 806, as shown, includes four rows of connector mechanisms 402; however, other numbers of rows are contemplated. The connector 806 may be made from a variety of materials, both flexible and stiff. In an embodiment, the connector 806 is made from a fabric material. In another embodiment, the connector 806 is made from a stiff material, such as plastic or cardboard.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The description and illustration of one or more embodiments provided in this application are not intended to limit or restrict the scope of the invention as claimed in any way. The embodiments, examples, and details provided in this application are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

What is claimed is:

1. A bedsheet system comprising:

a middle portion having a length and a width defining a plane, the length having a first end and a second end;

a foot connector attached to the first end of the middle portion and having a first sheet connector mechanism;

a head connector attached to the second end of the middle portion and having a second sheet connector mechanism;

an adapter capable of connecting a sheet to at least one of the first sheet connector mechanism or the second sheet connector mechanism; and wherein the foot connector and the head connector extend generally perpendicular from the plane of the middle portion.

2. The bedsheet system of claim 1, wherein the first sheet connector mechanism and the second sheet connector mechanism each comprises four rows of connector mechanisms.

3. The bedsheet system of claim 2, wherein at least one row of the four rows of connector mechanisms is a zipper.

4. The bedsheet system of claim 2, wherein each row of the four rows of connector mechanisms comprises three individual connectors.

5. The bedsheet system of claim 4, wherein the at least one of the first sheet connector mechanism of the second sheet connector mechanism is selected from one of: a hook and loop connector and a magnet.

6. The bedsheet system of claim 1, wherein the adapter comprises:

a base portion a first wing and a second wing, wherein the base portion is capable of connecting to the at least one of the first sheet connector mechanism or the second sheet connector mechanism, and wherein the first wing and the second wing are capable of connecting to a standard issue sheet.

7. The bedsheet system of claim 6, wherein the adapter comprises a complementary sheet connector mechanism selected from a zipper, a hook and loop connector, and a magnet.

8. The bedsheet system of claim 6, wherein the first wing and the second wing each comprise a magnet capable of holding the standard issue sheet between the first wing and the second wing.

9. The bedsheet system of claim 1, wherein the foot connector and the head connector comprise a material stiffer than a material of the middle portion.

10. The bedsheet system of claim 1, wherein the foot connector and the head connecter comprise a different number of sheet connector mechanisms.

11. The bedsheet system of claim 1, wherein the foot connector comprises two columns of the first sheet connector mechanism and the head connector comprises two columns of the second sheet connector mechanism.

12. The bedsheet system of claim 1, wherein a first sheet is capable of connecting to a first column of the foot connector and a second sheet is capable of connecting to a second column of the foot connector, wherein the second sheet is different than the first sheet.

13. A bedsheet system comprising:

a middle portion having a length and a width defining a plane, the length having a first end and a second end;

a foot connector attached to the first end of the middle portion and having a first sheet connector mechanism;

a head connector attached to the second end of the middle portion and having a second sheet connector mechanism;

wherein the foot connector and the head connector extend generally perpendicular from the plane of the middle portion; and wherein the first sheet connector mechanism and the second sheet connector mechanism each comprise a first wing and a second wing capable of connecting to a standard issue sheet.

14. The bedsheet system of claim 13, wherein at least one of the first sheet connector mechanism or the second sheet connector mechanism is selected from a hook and loop connector and a magnet.

15. The bedsheet system of claim 13, wherein the foot connector and the head connector comprise a material stiffer than a material of the middle portion.

16. The bedsheet system of claim 13, wherein the foot connector comprises two columns of the first sheet connector mechanism and the head connector comprises two columns of the second sheet connector mechanism.

17. The bedsheet system of claim 13, wherein a first sheet is capable of connecting to a first column of the foot connector and a second sheet is capable of connecting to a second column of the foot connector, wherein the second sheet is different than the first sheet.

18. A bedsheet system comprising:

a middle portion having a length and a width defining a plane, the length having a first end and a second end;

a foot connector attached to the first end of the middle portion and having a first sheet connector mechanism and a head connector attached to the second end of the middle portion and having a second sheet connector mechanism, wherein the foot connector and the head connector extend generally perpendicular from the plane of the middle portion;

at least one sheet comprising a complementary sheet connector mechanism, capable of removably connecting to at least one of the first sheet connector mechanism or the second sheet connector mechanism; and an adapter capable of connecting a sheet to the at least one of the first sheet connector mechanism or the second sheet connector mechanism.

19. The bedsheet system of claim 18, wherein the foot connector comprises two columns of the first sheet connector mechanism and the head connector comprises two columns of the second sheet connector mechanism, and wherein a first sheet is capable of connecting to a first column of the foot connector and a second sheet is capable of connecting to a second column of the foot connector, wherein the second sheet is different than the first sheet.

* * * * *